United States Patent [19]

Iritani et al.

[11] Patent Number: 4,581,912

[45] Date of Patent: Apr. 15, 1986

[54] APPARATUS FOR PROCESSING TERMINAL ENDS OF TUBES

[75] Inventors: Takeshi Iritani, Ageo; Matsuo Todaka; Mitsuo Yoshida, both of Kitamoto, all of Japan

[73] Assignee: Mitsubishi Kinzoku Kabushiki Kaisha, Tokyo, Japan

[21] Appl. No.: 739,038

[22] Filed: May 29, 1985

[30] Foreign Application Priority Data

Mar. 13, 1985 [JP] Japan ..... 60-35745

[51] Int. Cl.[4] ..... B21C 9/00; B21D 41/04

[52] U.S. Cl. ..... 72/45; 29/796; 72/283; 72/318; 72/370

[58] Field of Search ..... 29/726, 727, 796; 72/41, 43, 44, 45, 283, 316, 318, 367, 370

[56] References Cited

U.S. PATENT DOCUMENTS

| | | | |
|---|---|---|---|
| 1,913,206 | 6/1933 | Littler | 72/370 X |
| 2,308,120 | 1/1943 | Staples et al. | 72/45 |
| 3,243,986 | 4/1966 | Douthett et al. | 72/370 X |
| 3,399,559 | 9/1968 | Mitchell | 72/367 X |

FOREIGN PATENT DOCUMENTS

| | | | |
|---|---|---|---|
| 116923 | 7/1983 | Japan | 72/45 |
| 1209106 | 10/1970 | United Kingdom | 72/370 |

*Primary Examiner*—E. Michael Combs

*Attorney, Agent, or Firm*—Cushman, Darby & Cushman

[57] ABSTRACT

Disclosed is an apparatus for automatically processing an end portion of a tube disposed along a predetermined moving path so as to be movable toward and away from the moving path. A first clamping device is mounted on the base in front of the pointing device along the moving path. A tube press is disposed between the pointing device and the first clamping device for dimpling the tube wall to form axially spaced positioning sections thereon. A second clamping device is disposed between the tube press and the pointing device for clamping the end portion of the tube. A plug feeding device is disposed between the second clamping device and the pointing device for feeding a plug from a position out of the moving path to a position thereon. A plug inserting device includes an inserting nozzle movable in parallel to the moving direction of the tube for inserting the plug into the end portion of the tube. Lubricant is supplied into the tube through the inserting nozzle. The end portion of the tube is pointed by the pointing device.

9 Claims, 5 Drawing Figures

A

APPARATUS FOR PROCESSING TERMINAL ENDS OF TUBES

BACKGROUND OF THE INVENTION

1. Field of the Invention

The present invention relates to an apparatus for automatically inserting a plug into an end portion of a metal tube and processing the end portion into a pointed configuration, prior to a drawing of the tube using a die and the plug.

2. Prior Art

When a hollow tube is drawn by the use of a die and a plug, the plug is inserted into the tube to a location adjacent to an axial end face thereof, an end portion of the tube is pointed by a pointing device , and the pointed end portion is gripped by a chuck of a drawing apparatus and is caused to pass through the die hole so that an outer diameter of the tube is regulated by the die hole and a wall thickness of the tube is regulated by the plug.

Heretofore, the insertion of the plug into the tube before pointing the end portion thereof has been performed manually. Specifically, an operator slightly dimples, by a hammer, a portion of the tube remote from the axial end face thereof by a predetermined distance to form a first positioning section on the tube, inserts an oil supply nozzle into the tube to supply oil thereinto, manually inserts a plug from the axial end face of the tube to the first positioning section, thereafter, again slightly dimples by the hammer a portion of the tube intermediate the axial end face of the tube and the inserted plug to form a second positioning section on the tube for preventing the inserted plug from coming out of the tube, thereafter, inserts the end portion of the tube into the pointing device to point the end portion of the tube so as to provide a pointed end portion. In the prior art, such plug inserting operation has been entirely performed manually by an operator, except for the pointing operation by the pointing device, and it has been a great strain on the operator.

OBJECT AND SUMMARY OF THE INVENTION

An object of the present invention is to provide a tube end processing apparatus which is capable of automatically performing an inserting operation of a plug into an end portion of a tube and pointing the end portion, without any trouble for an operator.

According to the present invention, there is provided an automatic tube end processing apparatus comprising: a base disposed below a moving path along which a tube is to be moved; a pointing device mounted on the base so as to be movable toward and away from the moving path and having an insertion opening facing forwardly with respect to a moving direction of the tube; first clamping means mounted on the base in front of the pointing device along the moving path, for supporting and clamping the tube; a tube press for dimpling the tube, the tube press being disposed between the first clamping means and the pointing device so as to be movable along the moving path; second clamping means disposed between the tube press and the pointing device for clamping an end portion of the tube; plug feeding means disposed between the tube press and the pointing device for feeding a plug from a position out of the moving path to a position on the moving path; plug inserting means including an inserting nozzle movable in parallel to the moving direction of the tube for inserting the plug into the tube, the plug inserting means being disposed in the vicinity of the pointing device so as to enable the inserting nozzle to be moved toward and away from the moving path; and lubricant supply means communicating with the inserting nozzle for supplying lubricant into the tube through the inserting nozzle.

The automatic tube end processing apparatus in accordance with the present invention operates in such a manner that the first clamping means is actuated to support and clamp the tube, the tube press is actuated to dimple a portion of the tube to form thereon a positioning section, the plug positioned at the axial end face of the tube by the plug feeding means is inserted into the tube by the plug feeding means is inserted into the tube by the inserting nozzle of the plug inserting means, lubricant is supplied into the tube through the inserting nozzle, the tube press is again actuated to dimple a portion of the tube offset from the inserted plug toward the axial end face of the tube to form thereon a second positioning section for preventing the inserted plug from coming out of the tube, and the pointing device is actuated to draw or neck the end portion of the tube to complete a tube pointing.

DETAILED DESCRIPTION OF THE PREFERRED EMBODIMENT

Figure 1:
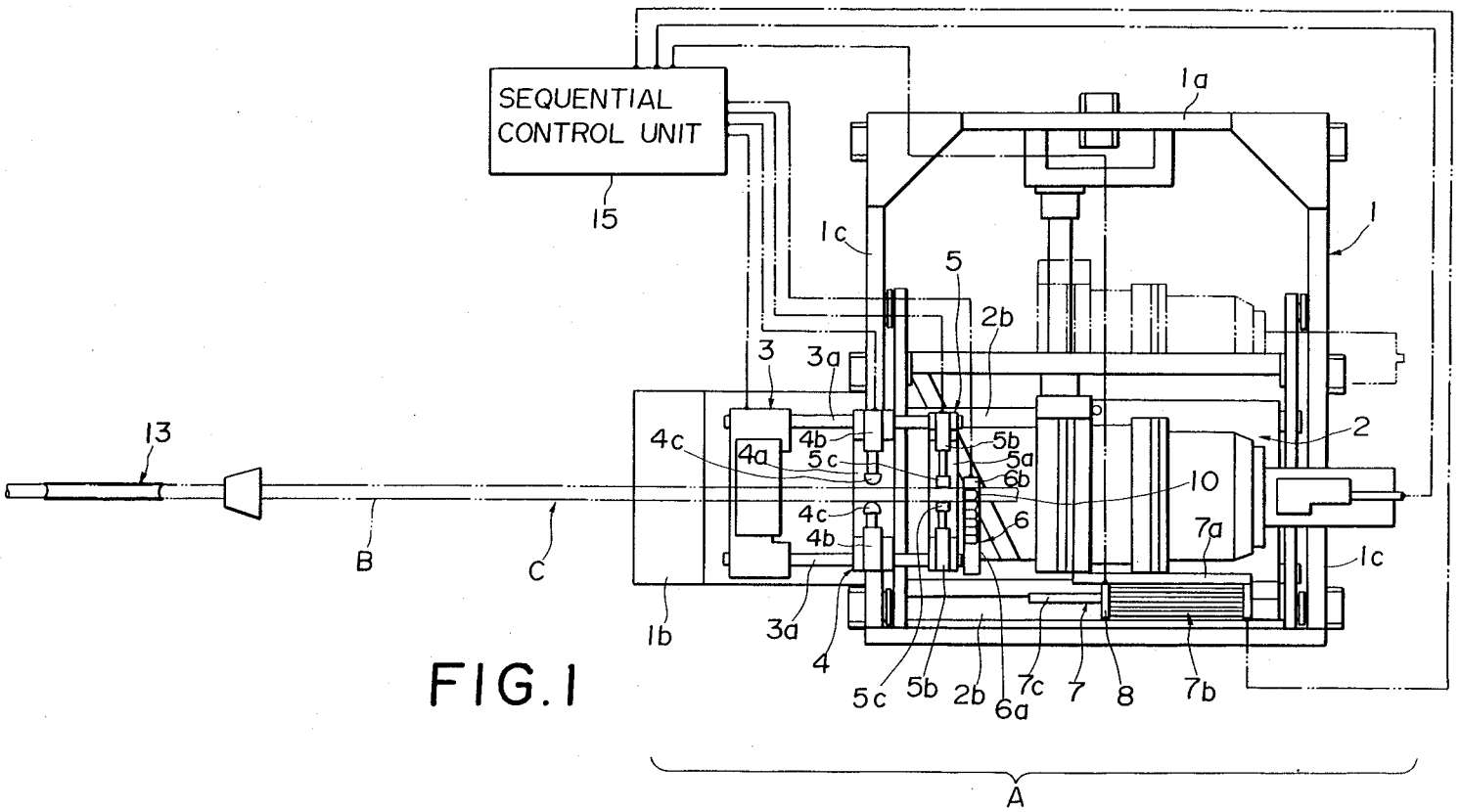
FIG. 1 is a plan view showing an automatic tube end processing apparatus in accordance with an embodiment of the present invention.
Figure 2:
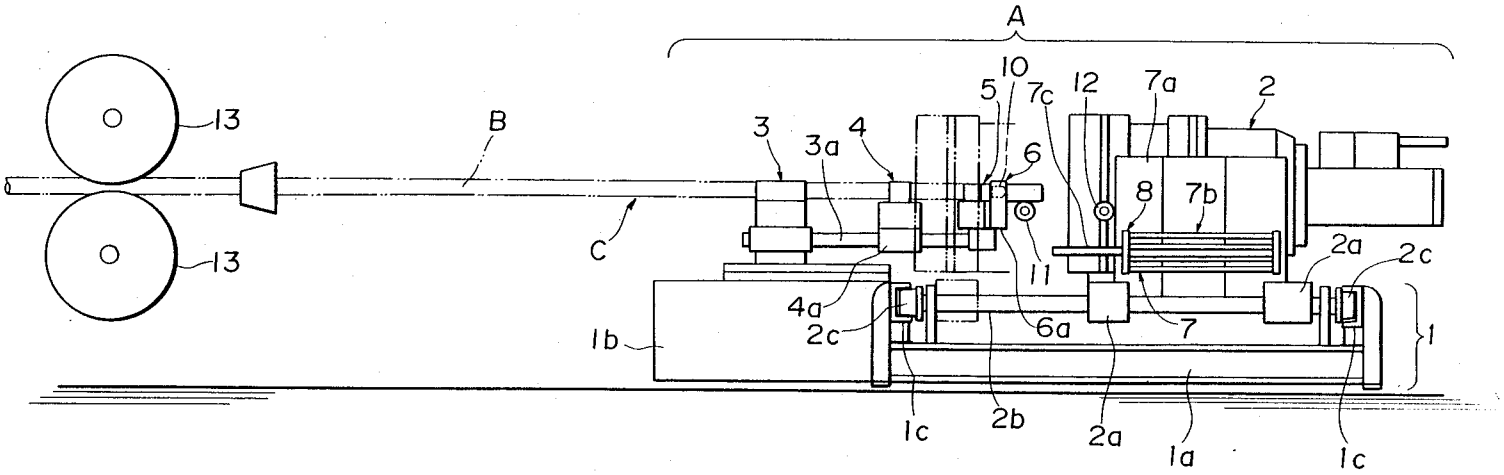
FIG. 2 is a front elevational view of the processing apparatus shown in FIG. 1.

Referring to FIGS. 1 and 2 which illustrate an automatic tube end processing apparatus, generally designated by the reference character A, in accordance with an embodiment of the present invention, the automatic tube end processing apparatus A comprises, as principal components, a base generally designated by the reference numeral 1 disposed below a moving path C along which a tube B shown by phantom lines is to be moved from the right to the left in FIGS. 1 and 2; a pointing device generally designated by the reference numeral 2 mounted on the base 1 at a trailing side thereof with reference to the moving direction of the tube B; a first clamping device 3 mounted on the base 1 in front of the pointing device 2 along the moving path C; a tube press generally designated by the reference numeral 4, a second clamping device generally designated by the reference numeral 5 and a plug feeding device generally designated by the reference numeral 6 which are disposed between the first clamping device 3 and the pointing device 2; a plug inserting device 7; and a lubricant supply device 8.

The base 1 comprised a rectangular base frame 1*a* and a table 1*b* fixedly connected to a side of the base frame 1*a* which is located forwardly with reference to the moving path C. A pair of spaced guide rails 1*c* extending perpendicularly to the moving path C are fixedly mounted on the base frame 1*a*.

The pointing device 2 comprises a casing and a publicly known drawing or pointing unit disposed within the casing. The casing includes a front wall having formed therein a central insertion opening through which an end portion of the tube B is inserted into the casing to point the end portion of the tube B. The pointing device 2 is fixedly mounted on a pair of mounts 2*a* with the insertion opening facing forwardly with respect to the moving direction of the tube B. The mounts 2*a* are slidably mounted on support rods 2*b* extending in parallel to the moving path C. Each of the support rods 2*b* has axial opposite ends thereof on which guide wheels 2*c* are rotatably mounted, respectively. The guide wheels 2*c* are in rotatable engagement with the guide rails 1*c* so as to be movable therealong. Thus, the pointing device 2 is supported on the base 1 so as to be horizontally movable in parallel to the moving path C and perpendicularly thereto. The pointing device 2 is supported on the guide rails 1*c* such that the insertion opening of the pointing device 2 is located at the same level as the moving path C.

The first clamping device 3 is a publicly known one which includes a chuck for automatically grip or clamp the tube B at any location along the moving path C. The first clamping device 3 is fixedly mounted on an upper surface of the table 1*b*. A pair of rods 3*a* have their respective one ends fixedly supported by the first clamping device 3 and horizontally extend in parallel to the moving path C toward the pointing device 2 with the moving path C being centrally located between the pair of rods 3*a*.

The tube press 4 is disposed between the first clamping device 3 and the pointing device 2 and comprises a press mount 4*a* slidably mounted on the guide rods 3*a* so as to be movable therealong, and a pair of piston and cylinder assemblies 4*b* fixedly mounted on the press mount 4*a* with the moving path C being located between the pair of piston and cylinder assemblies 4*b*. Each of the piston and cylinder assemblies 4*b* includes a piston rod extending horizontally and perpendicularly to the moving path C. A press head 4*c* is fixedly connected to an axial free end of each of the respective piston rods of the piston and cylinder assemblies 4*b* so that the press heads 4*c* face to each other. The piston and cylinder assemblies 4*b* are adapted to be actuated to move their respective piston rods so as to enable the press heads 4*a* to be moved toward and away from the moving path C, i.e., between a position within the moving path C and a position remote therefrom.

The second clamping device 5 is disposed between the tube press 4 and the pointing device 2 and comprises a clamp mount 5*a* slidably mounted on the guide rods 3*a* so as to be movable therealong, and a pair of piston and cylinder assemblies 5*b* fixedly mounted on the clamp mount 5*a* with the moving path C being located between the pair of piston and cylinder assemblies 5*b*. Each of the piston and cylinder assemblies 5*b* includes a piston rod extending horizontally and perpendicularly to the moving path C. A support head 5*c* is fixedly connected to an axial free end of each of the respective piston rods of the piston and cylinder assemblies 5*b* so that the support heads 5*c* face to each other. The piston and cylinder assemblies 5*b* are adapted to be actuated to move their respective piston rods so as to enable the support heads 5*c* toward and away from the moving path C.

The plug feeding device 6 is disposed between the second clamping device 5 and the pointing device 2 and comprises a magazine case receiving therein a plurality of plugs 10 in the form of a projectile arranged in a single row, and a loading unit 6*b* associated with the case 6*a* for taking one of the plugs 10 out of the case 6*a* and locating the taken-out plug 10 in a position on the moving path C as occasion demands. The case 6*a* has a front wall facing to the moving path C and having-formed therein an opening through which the loading unit 6*b* can take one of the plugs 10 out of the case 6*a*.

The plug inserting device 7 comprises a vertical guide frame 7*a* fixedly mounted on the pointing device 2, a piston and cylinder assembly 7*b* mounted on the guide frame 7*a* so as to be vertically movable therealong, and an inserting nozzle 7*c* fixedly connected to a piston rod of the piston and cylinder assembly 7*b*. The piston and cylinder assembly 7*b* is movable up and down along the guide frame 7*a* and is also movable horizontally together with the pointing device so as to enable the inserting nozzle 7*c* to be moved between a position in alignment with the moving path C and a position out of alignment therewith. The piston and cylinder assembly 7*b* has incorporated thereinto the lubricant supply device 8 for supplying lubricant oil into the inserting nozzle 7*c*.

The tube B is guided by guide rollers 11 and 12 and is delivered along the moving path C by a pair of pinch rolls 13 and 13 from the right to the left in FIGS. 1 and 2.

A sequential control unit 15 shown in FIG. 1 is electrically connected to limit switches (not shown) associated with the above described various components of the automatic tube pointing apparatus A, and is adapted to receive respective signals from the limit switches to automatically control the respective actuations of the various components.

The automatic tube end processing apparatus A having the described construction operates to insert the plug 10 into the end portion of the tube B and to point the end portion in a manner described hereunder.

When the tube B is delivered along the moving path C from a previous working station, the first clamping device 3 is in an inoperative position so that the chuck of the first clamping device 3 occupies a position away from the moving path C. Similarly, the press heads 4*c* of the tube press 4, the support heads 5*c* of the second clamping device 5 and the loading unit 6*b* of the plug feeding device 6 occupy their respective positions away from the moving path C. The pointing device 2 and the plug inserting device 7 occupy their respective positions shown by phantom lines in FIG. 1 away from the moving path C. Thus, the tube B can pass along the moving path C, and is delivered by the pinch rolls 13 and 13 from the right to the left in FIGS. 1 and 2 along the moving path C on the automatic tube pointing apparatus A. When the trailing axial end of the tube B is moved to a position between the second clamping device 5 and the plug feeding device 6, the rotation of the pinch rolls 13 and 13 are suspended to halt the movement of the tube B and, subsequently, the plug inserting operation and the pointing operation are performed.

As the movement of the tube B is halted, the first clamping device 3 is actuated to cause the chuck thereof to clamp and support the tube B, and the second clamping device 5 is actuated to cause the support heads 5*c* to be pressed against the trailing axial end portion of the tube B, to thereby support or hold the trailing axial end portion. Simultaneously, the plug inserting device 7 is slightly moved horizontally and is moved downwardly to locate the inserting nozzle 7c in a position in alignment with the moving path C so as to cause the inserting nozzle 7c to face to the trailing axial end face of the tube B.

Subsequently, the tube press 4 is actuated to cause the press heads 4c and 4c to be moved toward the tube B on the moving path C so as to be pressed against the opposite side faces of the tube B, to thereby slightly dimple the opposite sides of the tube B to form a first positioning section thereon, and the tube press 4 is again actuated to cause the press heads 4c to be moved away from the tube B. Then, the plug inserting device 7 is actuated to cause the inserting nozzle 7c to be horizontally moved forwardly to the left in FIG. 1 and 2 into the tube B from the axial end face thereof, and the lubricant supply device 8 is then actuated to supply oil into the tube B through the inserting nozzle 7c.

After the completion of the oil supply, the plug inserting device 7 is again actuated to cause the inserting nozzle 7c to be moved rearwardly. Subsequently, the plug feeding device 6 is actuated to cause the loading unit 6b to take one of the plugs 10 out of the case 6a and to bring the plug 10 to the position facing to the axial end face of the tube B. The plug inserting device 7 is once again actuated to move forwardly the inserting nozzle 7c to cause the same to urge the plug 10 into the end portion of the tube B until the plug 10 reaches the first positioning section on the tube B and, thereafter, to again move rearwardly the inserting nozzle 7c out of the tube B. The plug inserting device 7 is then moved upwardly and is returned to its home position.

Subsequently, the second clamping device 5 is actuated to move the support heads 5c away from the tube B. The tube press 4 is moved along the moving path C toward the axial end face of the tube B to a position between the inserted plug 10 and the axial end face of the tube B, and is again actuated to dimple the opposite sides of the tube B to form a second positioning section thereon for preventing the inserted plug 10 from coming out of the tube B.

Subsequently, the tube press 4 and the second clamping device 5 are moved toward the first clamping device 3 and, simultaneously, the pointing device 2 is moved toward the moving path C to receive the end portion of the tube 3 in the insertion opening and is actuated to apply the pointing operation to the received end portion of the tube B.

After the completion of the pointing operation by the pointing device 2, the pointing device 2 is moved away from the tube B and is returned to its home position shown by the phantom lines in FIGS. 1 and 2.

Then, the tube B is moved along the moving path C and is delivered to a subsequent working station, and a new tube B is delivered on the automatic tube end processing apparatus A.

The sequential control unit 15 is operative in response to the respective signals from the limit switches associated with the various components to automatically control the positioning of the tube B, the respective movements of the pointing device 2 and the plug inserting device 7, and the respective actuations of the first clamping device 3, tube press 4, second clamping device 5, plug feeding device 6, plug inserting device 7 and lubricant supply device 8.

With the automatic tube end processing apparatus A in accordance with the present invention, the inserting operation of the plug 10 into the tube B and the pointing operation on the end portion of the tube B can be performed automatically without relying on an operator's labor. Thus, operator's working of dimpling the tube by the hammer, the operator's working of inserting the plug 10 into the tube B and the operator's working of inserting the end portion of the tube B into the pointing device 2 become unnecessary to prevent a strain from being applied to the operator, to thereby considerably improve the working efficiency.

Figure 3:
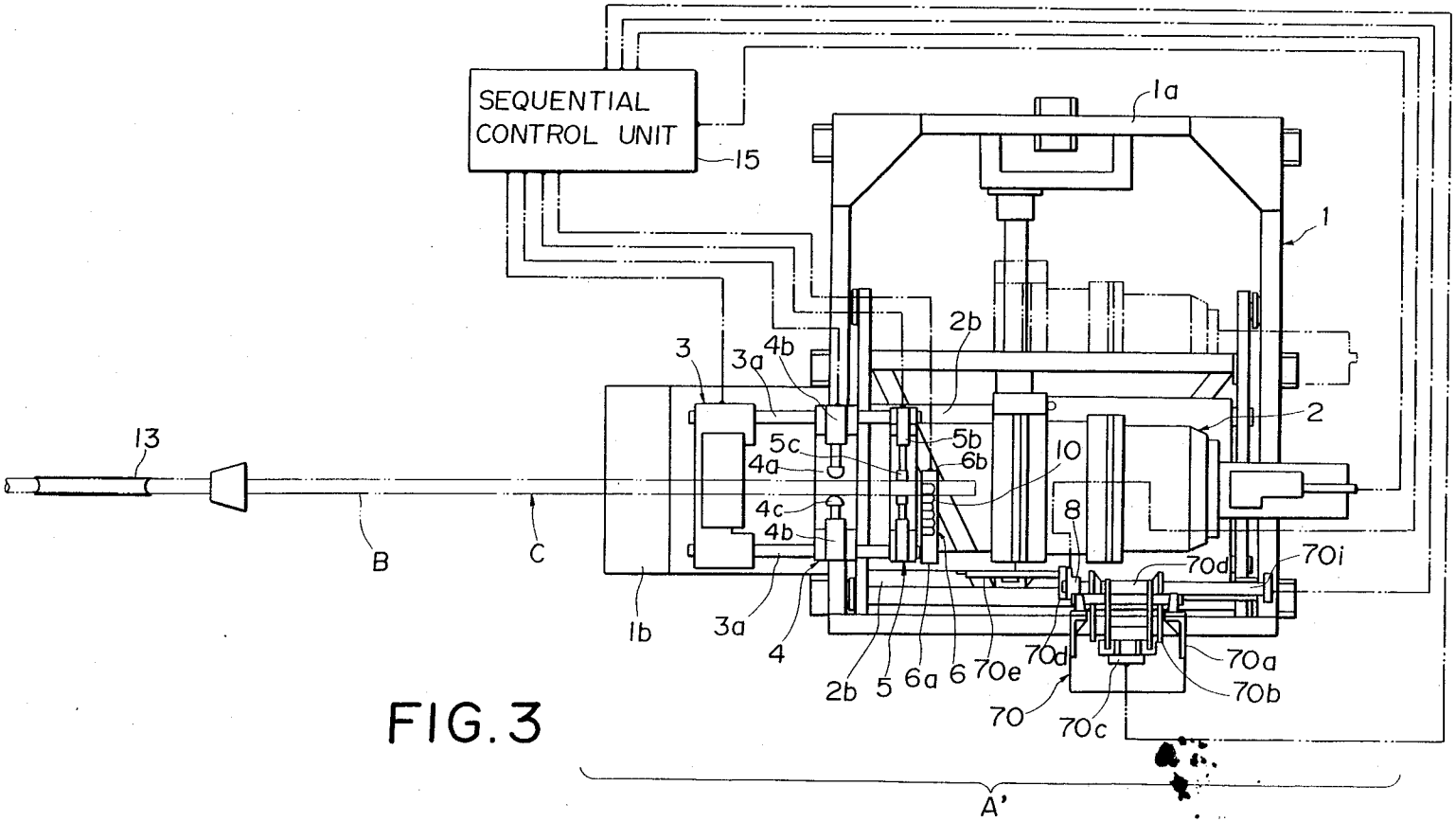
FIG. 3 is a plan view of an automatic tube end processing apparatus in accordance with another embodiment of the present invention.
Figure 4:
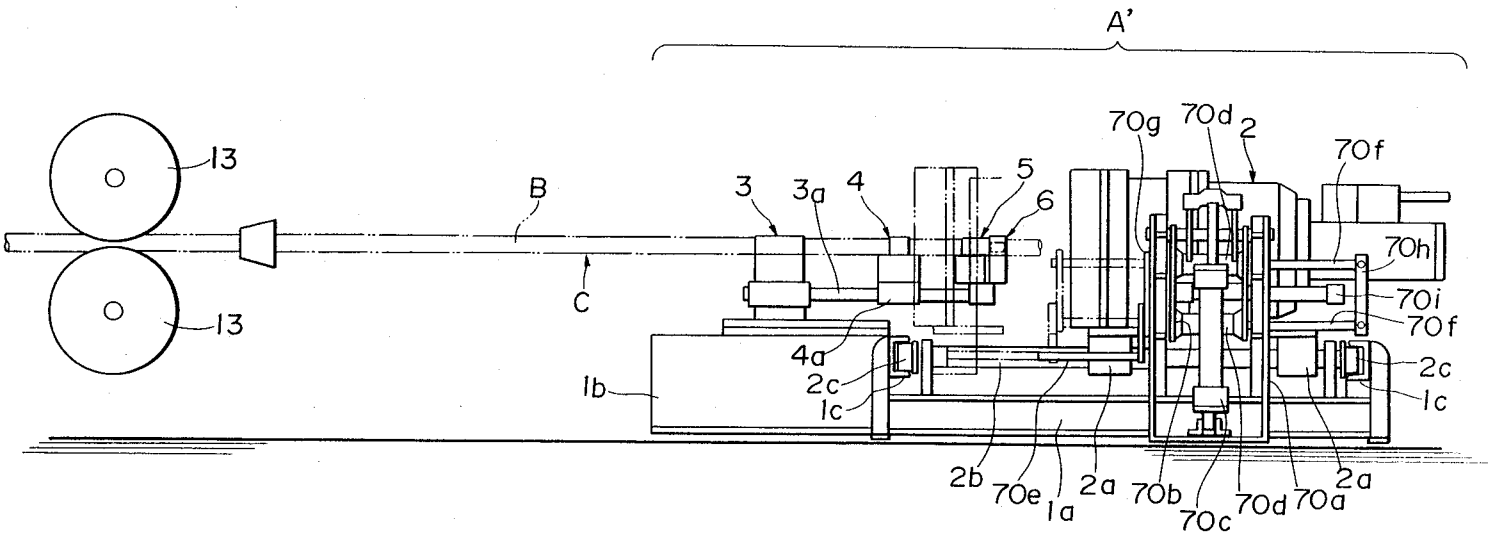
FIG. 4 is a front elevational view showing the processing apparatus shown in FIG. 3.
Figure 5:
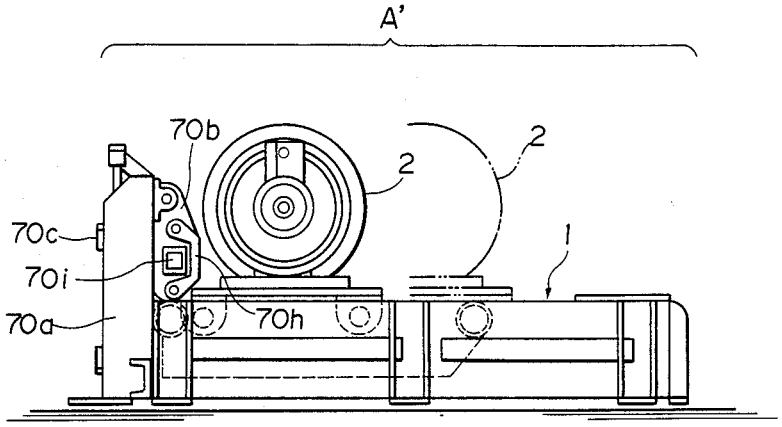
FIG. 5 is a side elevational view showing the processing apparatus shown in FIG. 3.

FIGS. 3 to 5 illustrate an automatic tube end processing apparatus generally designated by the reference character A′ in accordance with another embodiment of the present invention. The automatic tube end processing apparatus A′ comprises a plug inserting device, generally designated by the reference numeral 70, modifying the plug inserting device 7 shown in FIGS. 1 and 2. The remaining components of the apparatus A′ are substantially identical with those of the previous apparatus A and are designated by the same reference characters. Such identical or like components of the apparatus A′ will not be described in detail for simplification.

The plug inserting device 70 comprises a support frame 70a fixedly mounted on a side of the base frame 1a so as to face to a side face of the pointing device 2, a pivotable arm structure 70b pivotally mounted on the support frame 70a, and a piston and cylinder assembly 70c connected to the pivotable arm structure 70b to angularly move the same. A pair of parallel guide cylindrical members 70d are fixedly mounted on the pivotable arm structure 70b. Rods 70f extending in parallel to the moving path C are slidably supported within the guide cylindrical members 70d, respectively, so as to be guided thereby. The rods 70f have their respective axial opposite ends connected by bridging members 70g and 70h, respectively. An inserting nozzle 70e communicating with the lubricant supply device 8 is connected to the bridging member 70g, and a piston and cylinder assembly 70i has a piston rod which is also connected to the bridging member 70g. Thus, when the piston and cylinder assembly 70c is actuated to angularly move the pivotable arm structure 70b, the inserting nozzle 70e connected to the arm structure 70b through the bridging member 70g, rods 70f and guide members 70d is moved between a position in alignment with the moving path C and a position out of alignment therewith. In addition, when the piston and cylinder assembly 70i is actuated, the inserting nozzle 70e connected to the piston rod of the piston and cylinder assembly 70i through the bridging member 70g is moved in parallel to the moving path C.

The automatic tube end processing apparatus A′ having the described construction operates in a manner substantially the same as that in which the previously described apparatus A operates.

What is claimed is:

1. An automatic tube end processing apparatus, comprising:

a base disposed below a moving path along which a tube is to be moved;

a pointing device mounted on said base so as to be movable toward and away from said moving path and having an insertion opening facing forwardly with respect to a moving direction of the tube;

first clamping means mounted on said base in front of said pointing device along said moving path, for supporting and clamping the tube;

a tube press for dimpling the tube, said tube press being positioned between said first clamping means and said pointing device so as to be movable along the moving path;

second clamping means positioned between said tube press and said pointing device for clamping an end portion of the tube;

plug feeding means positioned between said second clamping means and said pointing device for feeding a plug from a position out of the moving path to a position on the moving path;

plug inserting means including an inserting nozzle mounted for movement in a direction parallel to the moving direction of the tube for inserting the plug into the end portion of the tube, said plug inserting means and said inserting nozzle being positioned adjacent said pointing device so as to be moveable toward and away from the moving path; and lubricant supply means communicating with said inserting nozzle for supplying lubricant into the tube through said inserting nozzle.

2. An automatic tube end processing apparatus defined in claim 1, including sequential control means for sequentially controlling said pointing device, said first and second clamping means, said tube press, said plug feeding means, said plug inserting means and said lubricant supply means in such a manner that said first clamping means is actuated to support and clamp the tube disposed along the moving path with an axial end face of the tube being located between said second clamping means and said pointing device, said second clamping means is actuated to clamp the end portion of the tube adjacent to the axial end face thereof to hold the end portion of the tube, said plug inserting means is actuated to locate said inserting nozzle in a position in alignment with the moving path to cause said inserting nozzle to face to the axial end face of the tube, said tube press is then actuated to dimple a portion of the tube between said first and second clamping means to form a first positioning section on the tube, said plug inserting means is the actuated to move forwardly said inserting nozzle to insert the same into the tube from the axial end face thereof, said lubricant supply means is actuated to supply lubricant into the tube through said inserting nozzle, after the completion of the supply of lubricant by said lubricant supply means said plug inserting means is again actuated to move rearwardly said inserting nozzle out of the tube, said plug feeding means is then actuated to bring the plug to the position on the moving path facing to the axial end face of the tube, said plug inserting means is once again actuated to move forwardly said inserting nozzle to cause the same to urge the plug into the end portion of the tube until the plug reaches said first positioning section, thereafter to move rearwardly said inserting nozzle out of the tube and then to move said inserting nozzle out of the position in alignment with the moving path, said tube press is moved along the moving path to a position between the inserted plug and the axial end face of the tube and is again actuated to dimple the tube to form a second positioning section thereon for preventing the inserted plug from coming out of the tube, and said pointing device is moved toward the moving path to receive the end portion of the tube in said insertion opening and is actuated to neck the end portion of the tube.

3. An automatic tube end processing apparatus defined in claim 2, wherein said plug inserting means is mounted on said pointing device so as to be movable in a substantially vertical plane to move said inserting nozzle between the position in alignment with the moving path and a position out of alignment therewith.

4. An automatic tube end processing apparatus defined in claim 3, wherein said nozzle inserting means includes a piston and cylinder assembly connected to said inserting nozzle for moving the same in parallel to the moving path.

5. An automatic tube end processing apparatus defined in claim 2, wherein said plug inserting means comprises a frame mounted on said base, and moving means connected to said inserting nozzle for angularly moving the same between the position in alignment with the moving path and a position out of alignment therewith.

6. An automatic tube end processing apparatus defined in claim 5, wherein said moving means of said plug inserting means comprises pivotable arm means and a piston and cylinder assembly drivingly connected to said inserting nozzle through said pivotable arm means for angularly moving said inserting nozzle between the position in alignment with the moving path and the position out of alignment therewith.

7. An automatic tube end processing apparatus defined in one of claims 4 and 5, wherein said tube press comprises a pair of press heads facing to each other and means for horizontally moving the pair of press heads toward and away from the moving path to cause said pair of press heads to dimple the tube to form said first and second positioning sections.

8. An automatic tube end processing apparatus defined in claim 7, wherein said second clamping means comprises a pair of support heads facing to each other, and means connected to said pair of support heads for horizontally moving the same toward and away from the moving path to cause said support heads to clamp therebetween the tube.

9. An automatic tube end processing apparatus defined in claim 8, wherein said plug feeding means comprises a case receiving therein a plurality of plugs, and means for taking one of the plugs out of said case and locating the taken-out plug into the position on the moving path.

* * * * *